US006805063B2

(12) United States Patent
Enns et al.

(10) Patent No.: US 6,805,063 B2
(45) Date of Patent: Oct. 19, 2004

(54) METHOD OF PULLING THE FREE END OF A NEEDLE THREAD FROM THE TOP TO THE BOTTOM SIDE OF A WORK PIECE AND SEWING MACHINE FOR PUTTING THE METHOD INTO PRACTICE

(75) Inventors: Johann Enns, Oerlinghausen (DE); Sevki Hosagasi, Bielefeld (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/626,241

(22) Filed: Jul. 24, 2003

(65) Prior Publication Data

US 2004/0173132 A1 Sep. 9, 2004

(30) Foreign Application Priority Data

Jul. 27, 2002 (DE) ..... 102 34 251

(51) Int. Cl.[7] ..... D05B 29/02; D05B 19/12

(52) U.S. Cl. ..... 112/239; 112/475.17; 112/470.01; 112/475.02

(58) Field of Search ..... 112/60, 470.01, 112/470.03, 151, 181, 239, 475.17, 475.01, 475.02

(56) References Cited

U.S. PATENT DOCUMENTS

| | | | | |
|---|---|---|---|---|
| 4,166,423 | A | 9/1979 | Brienza et al. | |
| 4,289,087 | A | 9/1981 | Takenoya et al. | |
| 4,508,043 | A | 4/1985 | Vollmar | |
| 4,616,586 | A | 10/1986 | Scholl | |
| 4,658,752 | A | 4/1987 | Keilmann et al. | |
| 6,354,233 | B1 * | 3/2002 | Hulshoff | 112/470.01 |

* cited by examiner

*Primary Examiner*—Peter Nerbun
*Assistant Examiner*—Brian Kauffman
(74) *Attorney, Agent, or Firm*—McGlew and Tuttle, P.C.

(57) ABSTRACT

In a method of pulling the free end of a needle thread from the top to the bottom of at least one work piece upon a first stitch of a seam that is to be sewn, use is made of a sewing machine with at least one presser which can be placed on, and lifted off, the work piece. The needle thread is held tight while a needle-thread loop is extended by the tip of the hook so that the free end is pulled through the work piece. While the needle thread is held tight, the presser is at least partially relieved. The relief time increases as the thickness of the work piece grows.

5 Claims, 3 Drawing Sheets

METHOD OF PULLING THE FREE END OF A NEEDLE THREAD FROM THE TOP TO THE BOTTOM SIDE OF A WORK PIECE AND SEWING MACHINE FOR PUTTING THE METHOD INTO PRACTICE

BACKGROUND OF THE INVENTION

1. Field of the Invention

The invention relates to a method of pulling the free end of a needle thread from the top to the bottom side of at least one work piece upon a first stitch of a seam that is to be sewn by a sewing machine, comprising a needle which is movable in up and down reciprocation, guiding a needle thread that has been taken from a needle-thread supply by a thread lever; at least one presser to be placed on, and lifted off, the at least one work piece; and a rotarily drivable hook, a tip of which seizes a needle-thread loop and extends it for forming a stitch, with the needle thread being held tight between the needle and the thread lever while the needle-thread loop is extended so that a free end is pulled through the work piece by the hook tip, and with the presser being at least partially relieved while the needle thread is held tight. The invention farther relates to a sewing machine for putting the method into practice.

2. Background Art

A method and a sewing machine of the generic type are known from U.S. Pat. No. 4,658,752. In this sewing machine, the pressure of the work-piece presser drive is adjustable, which is intended to enable even particularly thin, easily snapping threads and especially thick threads to be used, it being further possible to adjust the frictional force, acting on the needle thread, of the thread clamp.

It has been found that as work-piece thickness grows, pressure relief of the presser decreases i.e., when the thickness of the at least one work piece grows, the reliability decreases with which the free end of the thread, namely the starting end of the thread, is pulled from the top to the bottom side of the work piece upon a first stitch.

SUMMARY OF THE INVENTION

It is an object of the invention to embody a method of the generic type and a sewing machine for putting the method into practice such that adaptation to various sewing conditions, in particular to varying thickness of the at least one work piece, is attained.

In a method of the generic type, this object is attained in that the duration of relief rises as the thickness of a work piece increases. Preferably, this is done indirectly by the relief time depending on the length of stroke of the at least one presser, input of the length of stroke in adaptation to the sewing job being possible on the side of the machine.

In a sewing machine for putting into practice the method according to the invention, this object is attained in that a presser-relief drive is triggered by the control system in accordance with a function which is recorded in the control system, reflecting the dependency of the time of actuation of the presser-relief drive on the thickness of the at least one work piece. The invention is employable by special advantage in a sewing machine with alternating pressers and needle feed.

Details of the invention will become apparent from the ensuing description of an exemplary embodiment, taken in conjunction with the drawing.

DESCRIPTION OF THE PREFERRED EMBODIMENT

Figure 1:
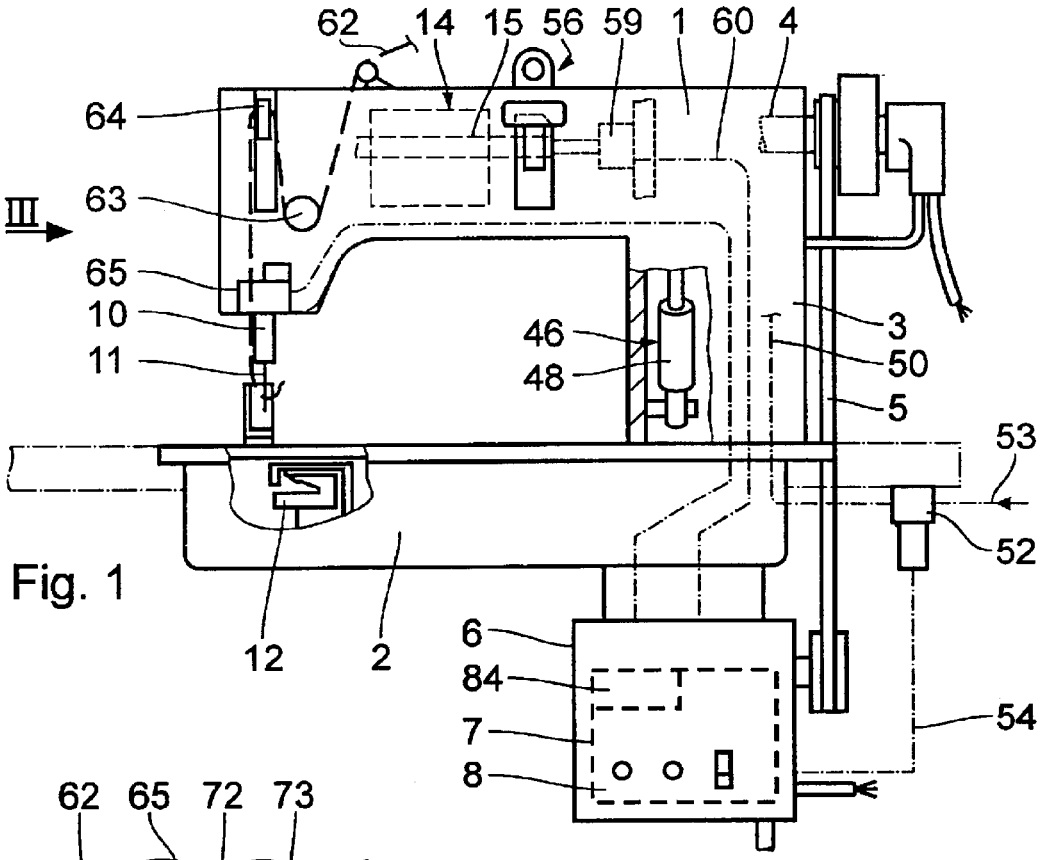
FIG. 1 is an elevation of a sewing machine.
Figure 2:
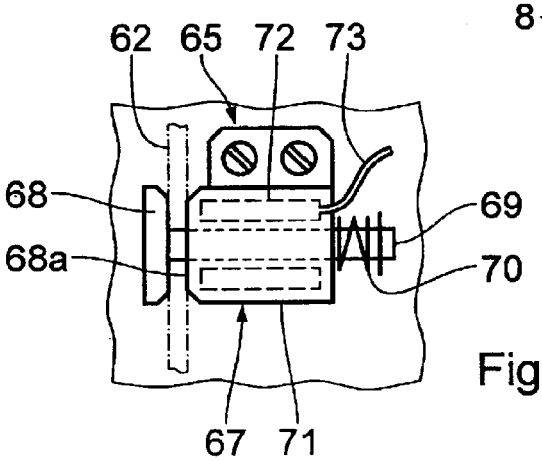
FIG. 2 is an illustration, on an enlarged scale, of a thread clamp of the sewing machine.

The sewing machine seen in the drawing comprises a top arm 1 and a bottom base plate 2 in the form of a casing, the two being assembled by a standard 3 to form a C-shaped casing. An arm shaft 4 is mounted in the arm 1, drivable via a belt drive 5 by a motor 6. A control box 7 is joined to the motor 6, housing a microprocessor control system 8. A needle bar 10 is driven in up and down reciprocation by the arm shaft 4 by means of a crank 9; a needle 11 is fixed to the lower end of the needle bar 10.

A hook 12 is disposed in the base plate 2, which is conventionally driven in rotation about its axis, derived from the arm shaft 4. The hook 12 is provided with a thread supply 13.

A lifting mechanism 14 is disposed in the arm 1, serving for setting the length of stroke a of work-piece pressers (described below); a setting shaft 15 forms part of it. This setting shaft 15 has a guiding groove 16 with a crosshead 17 longitudinally displaceable therein. An end of a lever 18 is pivotably mounted on the crosshead 17; the other end is articulated to a first arm 19 of an elbow lever 20. The elbow lever 20 is pivotably supported on a bearing 22, stationary on the machine, at the point of intersection of its first arm 19 and its second arm 21. A tie rod 23, which engages with a cam 24, acts approximately centrally on the lever 18; the cam 24 is coupled with the arm shaft 4.

The arm 1 is provided with a presser 25 which has a presser bar 27 that is vertically displaceable in a sliding bearing 26 and a presser foot 28 at the bottom end of the presser bar 27. By the side of the presser 25, provision is made for a feeder 29, equally having the function of a presser and including a feeder bar 31 which is displaceable in a sliding bearing 30 and to the bottom end of which is fixed a feeder foot 32. The sliding bearing 30, and thus the feeder 29, are mounted on a swing frame 33 where also the needle bar 10 is lodged for displacement in another sliding bearing 34, the feeder bar 31 and the needle bar 10 being parallel to one another. The swing frame 33 is pivotably mounted on a bearing 35 in the arm 1, driven by a sliding gear transmission via a tie rod 36 that is pivotably joined to the swing frame 33 via a bearing 37. A sliding gear transmission of this type is known from U.S. Pat. No. 4,616,586.

Actuation of the presser 25 and feeder 29 takes place from the elbow lever 20, the second arm 21 of which is articulated to a triangular driving lever 38, the second arm 21 being joined to a tip of the driving lever 38 by way of a tie rod 21*a*. Transmission levers 39, 40 are articulated to the two other tips; they are articulated to the upper ends of the presser bar 27 and the feeder bar 31, respectively. The driving lever 38 pivotably supports itself via a rod 41 on a bearing 42 which is disposed in the arm 1. The rod 41 is loaded by a pre-stressed helical compression spring 43 so that the rod 41 and thus the presser 25 and the feeder 29 are forced downwards. Disposed underneath the rod 41 is a stop lever 44 which is also pivotable in the bearing 42, having a stop 45 that is allocated to the rod 41 underneath the compression spring 43. A stop setting drive 46 in the form of a pneumatically actuated piston cylinder drive acts on the stop lever 44, its piston rod 47 being articulated to the stop lever 44 while its cylinder 48 is joined to the standard 3. The drive 46 is a unilaterally actuated piston cylinder drive i.e., a piston 49 is mounted on the piston rod 47, with compressed air being admitted via a compressed-air piping 50 to the side of the piston 49 that faces away from the piston rod 47 so that upon admission of compressed air the piston rod 47 is pushed out of the cylinder 48, whereby the stop 45 is adjusted towards the stop lever 44. Upon pressure relief, the piston 49 and thus the piston rod 47 are restored by means of a readjusting spring 51. Actuation by compressed air is controlled by a 3/2-port directional control valve 52 to which compressed air is supplied from a source of compressed air (not shown) via compressed-air supply piping 53. On the other hand it is operated electromagnetically, to which end it is connected to the control system 8 via an electric line 54.

The setting shaft 15 for the presser 25 is provided with a working lever 55, by means of which to pivot the setting shaft 15 about its axis, changing the position of the crosshead-17-guiding groove 16. The working lever 55 serves to fix the length of stroke a of the presser 25 and the feeder 29. The smallest and greatest adjustable length of stroke a is defined by two adjustable limit stops 56, 57 which are mounted on the arm 1 and between which acts a lever 58 that is mounted on the setting shaft 15. For example, 2.0 mm$\leqq$a$\leqq$8.0 mm applies.

A rotary potentiometer 59 is coupled with the setting shaft 15, via a signal line 60 signalling, to the control system 8, the position of angle of rotation of the setting shaft 15 as a measured variable.

Figure 4:
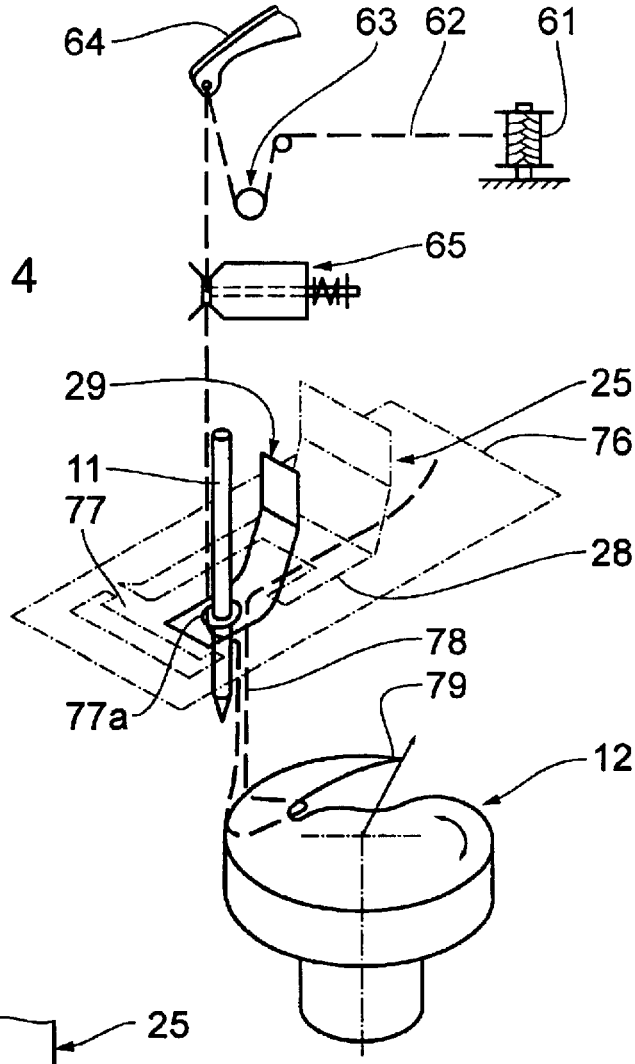
FIG. 4 is a perspective diagrammatic view of the stitch-forming area of the sewing machine.
Figure 5:
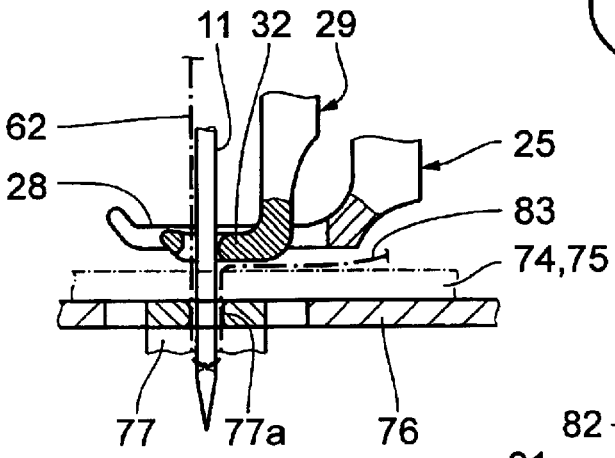
FIG. 5 is an illustration of the needle of the sewing machine in downward motion upon production of a first stitch in the work pieces.
Figure 6:
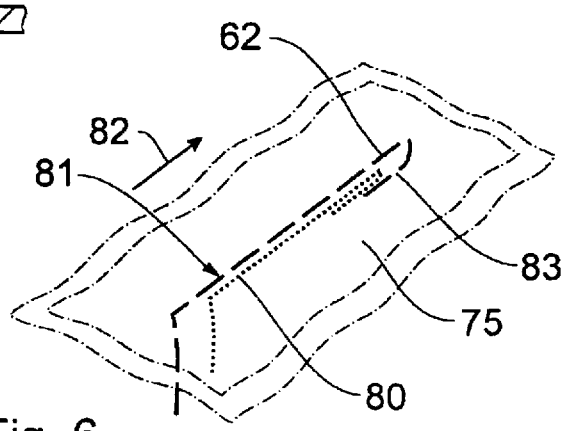
FIG. 6 is an illustration of two work pieces assembled by a seam, with the tail pieces of needle and hook threads on the bottom side of the work pieces.

The arm 1 includes a needle-thread supply 61, which is illustrated only in FIG. 4. From this supply 61, the needle thread 62 is conventionally led via a thread tightener 63, a thread lever 64 and a thread clamp 65 to the needle 11. The thread tightener 63 is described in U.S. Pat. No. 4,289,087. It comprises two tension disks 68, with the needle thread 62 passing there-between, and a solenoid 67. Corresponding to the voltage fed to the solenoid 67, adjustable frictional force is exercised on the needle thread 62 between the tension disks 66, conferring a corresponding tension to the thread.

The thread clamp 65, which is directly upstream of the needle 11, comprises a tension disk 68 fixed to a guide bar 69 that is again loaded by a compression spring 70, whereby the tension disk 68 is forced against an abutment 71 that is fastened to the arm 1. Provided on the abutment 71 is a solenoid 72 formed by wire winding 72 which can be triggered via a line 73 from the control system 8.

For a sewing job, two work pieces 74, 75 are passed one on top of the other on to the needle plate 76 that is provided on the base plate 2. The needle plate 76 has a recess which a bottom feeder 77 projects through, having a stitch hole 77*a* for the needle 11 to pass through. The bottom feeder 77 is kinematically linked to the mentioned sliding gear transmission such that the stitch hole 77*a* is moved synchronously with the needle 11 stitching into the work pieces 74, 75 during stitch formation and equally performing the feed motion. The described design and mode of operation are familiar general practice in so-called needle-feed sewing machines.

The two work pieces 74, 75 have a total thickness s. The length a by which the feet 28, 32 are lifted above the work pieces 74, 75 is set by an operator by means of the working lever 55. Assumably the operator increases the length of stroke a as the thickness s of the work pieces 74, 75 grows, the compressibility of the two work pieces 74, 75 increasing as the thickness s increases.

In a standard sewing operation, the needle 11, together with the needle thread 62, passes through the work pieces 74, 75 into the stitch hole 77*a*. The feeder foot 32 is in a lowered and the feeder 77 in an elevated position so that the work pieces 74, 75 are clamped between the feeder 77 and the feeder foot 32. At this time the presser foot 28 is above the work piece 74 corresponding to the length of stroke a so that unimpeded feed of the work pieces 74, 75, with the needle 11 passed there-through, is possible in the direction of feed 82. The thread clamp 65 is opened so that the needle thread 62 can be supplied unimpeded by the downward motion of the needle 11.

When the needle 11, after passing through its lowermost position, has again moved upwards by approximately 2.5 mm, the tip 79 of the rotating hook 12 seizes the needle-thread loop 78 formed upon upward motion of the needle 11. With the upward motion proceeding, the needle 11 finally retracts from the work pieces 74, 75. Meanwhile the hook 12 has caused the needle thread loop 78 to entirely surround the hook-thread supply 13. Then the excess needle thread 62 is retracted by the thread lever 64 with a two-thread lock-stitch seam 81 formning. Afterwards the presser foot 28 and the feeder foot 32 are shifted so that the presser foot 28 is placed on the work pieces 74, 75 and the feeder foot 32 is lifted off by the length of stroke a. During a standard sewing operation, the thread clamp 65 only serves as a guide of the needle thread 62, not braking it. The described way of stitch forming and the mode of alternating operation of the feet 28, 32 with needle feed are familiar and general practice.

When a first stitch of a seam 81 is to be sewn, the free end 83 of the needle thread 62 i.e., the needle-thread starting end, is above the work pieces 74, 75; it is clamped between the upper work piece 75 and the presser foot 28 by a force that depends on the pre-load of the compression spring 43. For this free end 83 to be pulled downwards through the work pieces 74, 75 when the needle-thread loop 78 is extended upon corresponding revolution of the hook tip 79, the presser foot 28 must be relieved while the needle-thread loop 78 is extended. This is effected by corresponding actuation of the stop setting drive 46 by compressed air, whereby the stop lever 44 and the stop 45 are elevated, bearing against the rod 41. In doing so, the triangular driving lever 38 is slightly pivoted, as a result of which the presser bar 27 and thus the presser foot 28 are slightly lifted without the presser foot 28 being removed from the work pieces 74, 75, which implies pressure relief of the work pieces 74, 75 and, consequently, reduction of the frictional force that impedes the free end 83 of the needle thread 62 in being pulled out. The accompanying downward motion of the feeder foot 32 is of no importance functionally, the foot 32 not coming in touch with the work pieces 74, 75. As can be seen from the above, the stop setting drive 46 is a presser-25-relief drive. Relieving the feeder foot 32 for the free end 83 of the needle thread 62 to be pulled to the bottom side of the work piece 75 is in principle known from U.S. Pat. No. 4,658,752.

Figure 7:
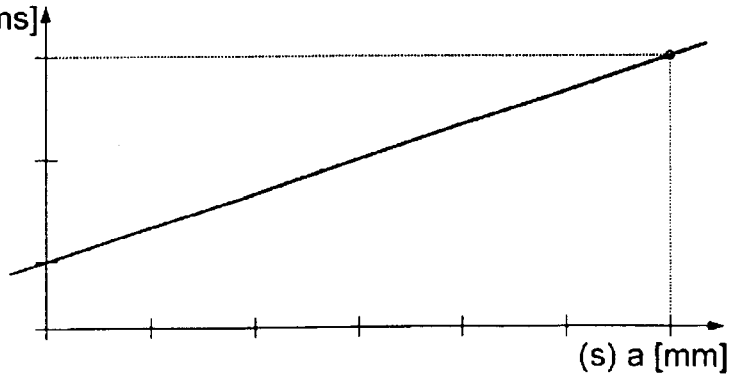
FIG. 7 is a path-time diagram plotting the time of operation of a presser relief drive over the length of stroke of the presser.
Figure 3:
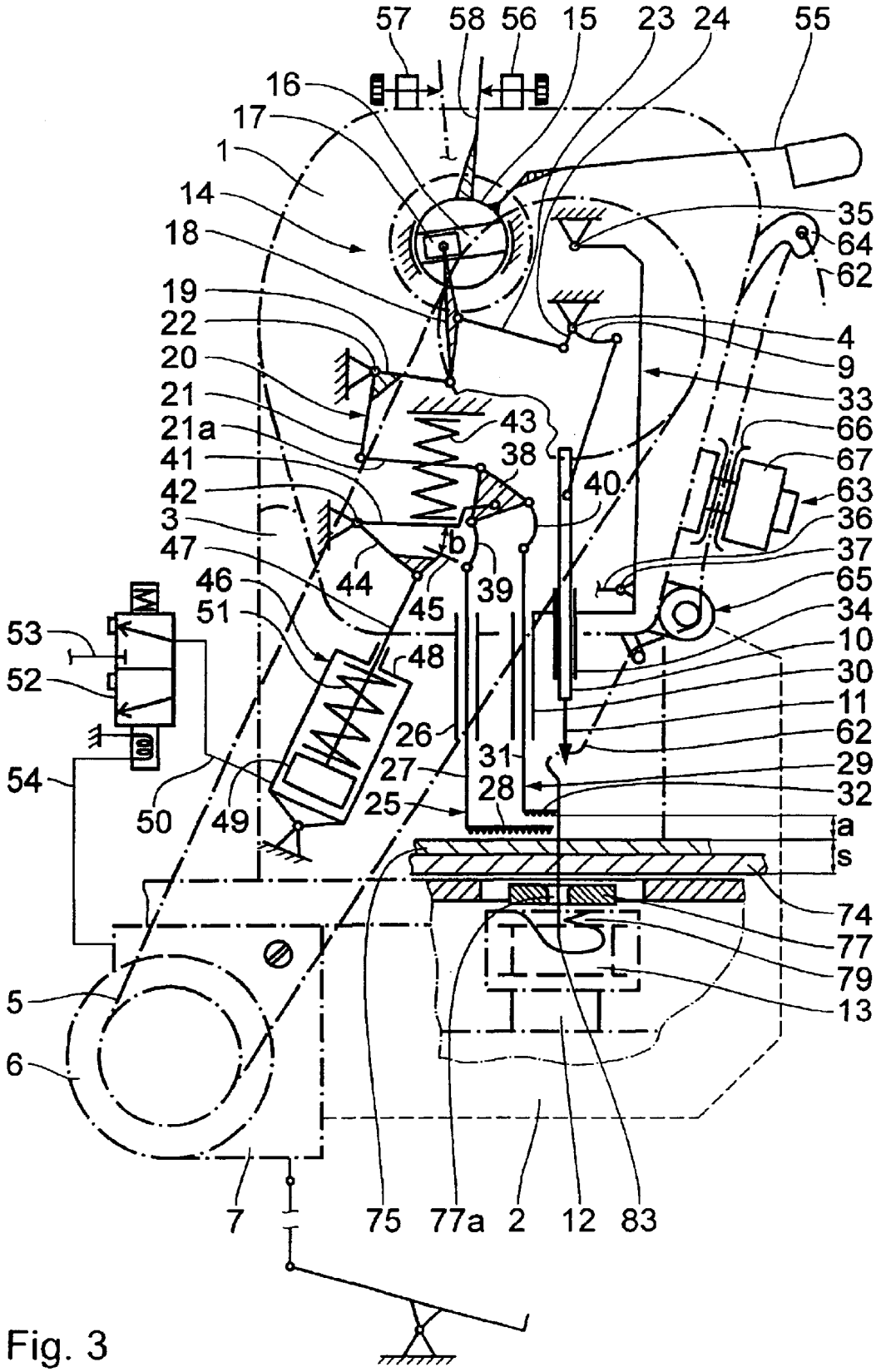
FIG. 3 is a diagrammatic side view, on an enlarged scale, of the sewing machine in accordance with the arrow III of FIG. 1.

The distance b of the stop 45 from the rod 41 grows as the thickness s of the work pieces 74, 75 increases i.e., the idle stroke from when the piston rod 47 starts extending to the moment when the stop 45 bears against the rod 41, increases as work-piece thickness s increases. For this to be compensated, the time of activation of the stop setting drive 46 is increased as the length of stroke a increases, which takes place in accordance with an empirically determined function roughly outlined in FIG. 7, where the actuation time t is plotted above the length of stroke a. This function is recorded in a ROM 84 of the control system 8. The length of stroke a is passed to the control system 8 by the rotary potentiometer 59 upon corresponding adjustment of the setting shaft 15, there setting off the valve 52, nd thus the drive 46, to be triggered in accordance with the function t=f(a). The greater the work piece thickness s, the greater is the length of stroke a—as outlined above. Any increase in length of stroke a is accompanied with an increase in the duration of triggering of the stop setting drive 46, which compensates the time loss during idle stroke over the length b. Moreover the compressibility of the work pieces 74, 75, which increases as the thickness s of the work pieces 74, 75 grows, is balanced.

What is claimed is:

1. A method of pulling a free end (83) of a needle thread (62) from a top to a bottom side of at least one work piece (74, 75) upon a first stitch of a seam (81) that is to be sewn by a sewing machine, comprising a needle (11) which is movable in up and down reciprocation, guiding a needle thread (62) that has been taken from a needle-thread supply (61) by a thread lever (64);

at least one presser (25) to be placed on, and lifted off, the at least one work piece (74, 75) by a length of stroke (a); and a rotarily drivable hook (12), a tip (79) of which seizes a needle-thread loop (78) and extends it for forming a stitch, with the needle thread (62) being held tight between the needle (11) and the thread lever (64) while the needle-thread loop (78) is extended so that a free end (83) is pulled through the work piece (74, 75) by the hook tip (79), and with the presser (25) being at least partially relieved over a relief time (t) while the needle thread (62) is held tight;

wherein as the at least one work piece (74, 75) increases in thickness (s), the relief time (t) rises.

2. A method according to claim 1, wherein the presser (25) is relieved in dependence on the length of stroke (a) of the at least one presser (25).

3. A sewing machine for putting into practice a method of pulling a free end (83) of a needle thread (62) from a top to a bottom side of at least one work piece (74, 75) upon a first stitch of a seam (81), the sewing machine comprising a needle (11) which is movable in up and down reciprocation, guiding a needle thread (62) that has been taken from a needle-thread supply (61) by a thread lever (64);

at least one presser (25) to be placed on, and lifted off, the at least one work piece (74, 75) by a length of stroke (a); and a rotarily drivable hook (12), the tip (79) of which seizes a needle-thread loop (78) and extends it for forming a stitch, a needle-thread-(62) clamp (65) which is stationarily provided between the thread lever (64) and the needle (11);

a presser drive; and a control system (8) for the thread clamp (65) and the presser drive;

wherein a presser-relief drive is provided to be triggered by the control system (8) in accordance with a function which is recorded in the control system (8), reflecting a dependency of the time of actuation of the presser-relief drive on the thickness (s) of the at least one work piece (74, 75).

4. A sewing machine according to claim 3, wherein a feeder (29) is provided, which is drivable alternately of the presser (25);

wherein a joint drive is provided for the presser (25) and the feeder (29); and wherein the presser-relief drive is a presser-lift-off drive (46).

5. A sewing machine according to claim 4, wherein an adjustable lifting mechanism (14) is provided for adjustment of the length of stroke (a) of the presser (25); and wherein a potentiometer (59), which is coupled with the lifting mechanism (14), is provided for detection and transmission, to the control system (8), of a measured variable representing the length of stroke (a) of the presser (25) which is adjusted on the lifting mechanism (14).

* * * * *